US009797199B1

(12) United States Patent
Gochis

(10) Patent No.: US 9,797,199 B1
(45) Date of Patent: Oct. 24, 2017

(54) HIGH SPEED PRECISION GUIDE DEVICE FOR CREATING HOLES FOR PILES OR OTHER SUPPORT MEMBERS

(71) Applicant: Bernard J. Gochis, Westminster, CO (US)

(72) Inventor: Bernard J. Gochis, Westminster, CO (US)

( * ) Notice: Subject to any disclaimer, the term of this patent is extended or adjusted under 35 U.S.C. 154(b) by 0 days.

(21) Appl. No.: 15/586,712

(22) Filed: May 4, 2017

Related U.S. Application Data

(62) Division of application No. 15/070,282, filed on Mar. 15, 2016, now Pat. No. 9,677,340, which is a division of application No. 13/532,602, filed on Jun. 25, 2012, now abandoned.

(60) Provisional application No. 61/500,397, filed on Jun. 23, 2011.

(51) Int. Cl.

| | |
|---|---|
| ***E21B 7/26*** | (2006.01) |
| ***E21B 3/02*** | (2006.01) |
| ***E02D 13/04*** | (2006.01) |
| ***E21B 7/02*** | (2006.01) |
| *E21B 4/14* | (2006.01) |
| *E21B 4/02* | (2006.01) |

(52) U.S. Cl.
CPC ..... *E21B 7/26* (2013.01); *E02D 13/04* (2013.01); *E21B 3/02* (2013.01); *E21B 7/02* (2013.01); *E21B 4/02* (2013.01); *E21B 4/14* (2013.01)

(58) Field of Classification Search
CPC ... E02D 7/10; E02D 13/04; E21B 3/02; E21B 4/02; E21B 4/14; E21B 7/26; E21B 7/02
See application file for complete search history.

(56) References Cited

U.S. PATENT DOCUMENTS

| | | | | |
|---|---|---|---|---|
| 3,721,305 | A * | 3/1973 | Mayer | E21B 7/02 173/147 |
| 3,730,285 | A * | 5/1973 | Anderson | E21B 7/021 175/122 |
| 4,099,579 | A | 7/1978 | Stormon | |
| 4,336,840 | A | 6/1982 | Bailey | |
| 4,694,913 | A | 9/1987 | McDonald et al. | |
| 5,273,124 | A | 12/1993 | Lloyd et al. | |
| 5,375,664 | A | 12/1994 | McDowell | |
| 5,690,184 | A * | 11/1997 | Tsuchiya | E21B 19/24 173/185 |
| 5,778,987 | A | 7/1998 | Baiden et al. | |

(Continued)

*Primary Examiner* — Robert E Fuller
*Assistant Examiner* — Christopher Sebesta
(74) *Attorney, Agent, or Firm* — James A. Sheridan; Sheridan Law, LLC

(57) ABSTRACT

A guide device and associated methods for forming a hole in the ground using compression or other means. In one example, the guide device includes a compression hammer having a hammer tip; a guide frame member for guiding the compression hammer into one or more positions along the guide frame member; and a movement control assembly securing the compression hammer to the guide frame, the movement control assembly selectively moving said compression hammer along said guide frame, so that said compression hammer forms the hole in the ground. By compressing soil materials, which has the effect of increasing soil density around the hole, a more rigid and accurate hole (i.e., within higher dimensional tolerances) is created when compared with holes created by drilling/boring/excavation.

15 Claims, 11 Drawing Sheets

(56) References Cited

U.S. PATENT DOCUMENTS

| | | | | |
|---|---|---|---|---|
| 5,944,452 | A * | 8/1999 | Reinert, Sr. | E02D 7/20 173/184 |
| 6,047,771 | A * | 4/2000 | Røynestad | E21B 19/08 166/377 |
| 7,640,998 | B2 | 1/2010 | Howell, Jr. | |
| 2007/0261869 | A1 * | 11/2007 | In | E21B 4/14 173/13 |
| 2008/0217037 | A1 * | 9/2008 | Howell | E21B 7/022 173/28 |
| 2008/0236853 | A1 | 10/2008 | Nakayabu | |

* cited by examiner

HIGH SPEED PRECISION GUIDE DEVICE FOR CREATING HOLES FOR PILES OR OTHER SUPPORT MEMBERS

CROSS REFERENCE TO RELATED APPLICATION

This application is a division of prior U.S. patent application Ser. No. 15/070,282, filed Mar. 15, 2016 by Bernard J. Gochis for HIGH SPEED PRECISION GUIDE DEVICE FOR CREATING HOLES FOR PILES OR OTHER SUPPORT MEMBERS, which is a divisional of prior U.S. patent application Ser. No. 13/532,602, filed Jun. 25, 2012 by Bernard J. Gochis for HIGH SPEED PRECISION GUIDE DEVICE FOR CREATING HOLES FOR PILES OR OTHER SUPPORT MEMBERS, which claims priority under 35 U.S.C. §119(e) to U.S. Provisional Patent Application No. 61/500,397 filed Jun. 23, 2011 entitled "High Speed Precision Guide Device for Creating Holes for Piles or Other Support Members" the disclosure of each of the above-identified applications is hereby incorporated by reference in its entirety.

FIELD OF THE INVENTION

This invention relates, in general, to devices that create precise holes in the ground.

BACKGROUND OF THE INVENTION

Various conventional techniques exist for creating holes in the ground to receive a pile, piers, anchors or support members. For instance, conventional techniques include use of a large drill with a rotary drill bit, which bores out the soils or other materials below ground.

However, as recognized by the present inventor, situations exist where it is undesirable or impractical to bore out materials from below the ground surface, for instance, when the below ground soils are weak, which therefore tends to collapse the hole as it is drilled. In another example, as recognized by the present inventor, boring out the soils (known as spoils) may be undesirable and impermissible on contaminated sites or contaminated land.

As recognized by the present inventor, what is needed is a device for creating a hole that does not create spoils during creation of the hole, such as a pilot hole for later insertion of a pile within the pilot hole.

SUMMARY

In light of the above and according to one broad aspect of one embodiment of the present invention, disclosed herein is a guide device for forming a hole in the ground. In one example, the guide device includes a compression hammer coupled with a shaft having a hammer tip; a guide frame member for guiding the compression hammer into one or more positions along the guide frame member; and a movement control assembly securing the compression hammer to the guide frame, the movement control assembly selectively moving said compression hammer along said guide frame, so that said compression hammer forms the hole in the ground. By compressing soil materials, which has the effect of increasing soil density around the hole, a more rigid and accurate hole (i.e., within higher dimensional tolerances) is created when compared with holes created by drilling/boring/excavation.

In one example of an embodiment of the invention, the hammer tip has a circular cross-section and may be substantially flat. The compression hammer may be hydraulic, electric or a conventional compression hammer. The compression hammer may be connected with an elongated solid cylindrical shaft, and one or more portions of the shaft may be removable.

In another example, in place of the compression hammer, an auguring tool, boring tool, displacement tool, or drill could be used, powered by air, electricity or hydraulics.

In another example of an embodiment of the invention, the guide frame member may be adapted to be connected to an excavator. The guide frame member may include an I-beam portion, and the guide frame member may have on one end a centering sleeve for receiving a portion of a shaft of the hammer, for instance in a substantially parallel relationship with the guide frame member. The guide frame member may have on one end a centering plate adapted to be positioned within an alignment device that is secured to the ground.

In another example of an embodiment of the invention, the movement control assembly may include a drive motor coupled with a mounting plate, the mounting plate secured to the compression hammer. The movement control assembly may controllably move the mounting plate secured to the compression hammer upwardly and downwardly along the guide frame member.

The guide device may also be used with an alignment system for accurate and precise placement of the shaft during hole creation.

According to another broad aspect of another embodiment of the present invention, disclosed herein is a guide device for forming a hole in the ground. In one example, the guide device includes a hammer having a hammer tip; a guide frame member for guiding the hammer into one or more vertical positions along the guide frame member; and a movement control assembly between the hammer and the guide frame, the movement control assembly selectively moving said hammer downwardly and upwardly along said guide frame so that said hammer tip penetrates the ground to form the hole.

In one embodiment, the hammer has an elongated solid cylindrical shaft terminating at the hammer tip. The hammer may have a removable shaft portion.

The guide frame member can be adapted to be connected to an excavator for positioning the guide device in different locations to form multiple holes. The guide frame member may be formed to include an I-beam portion. In one example, the guide frame member further comprises a centering sleeve with a centering hole for receiving and aligning a portion of a shaft of the hammer; and a centering plate adapted to be positioned within an alignment device that is secured to the ground.

According to another broad aspect of another embodiment of the present invention, disclosed herein is a method for guiding a percussion hammer device with a shaft to create a hole in the ground. In one example, the method includes connecting the percussion hammer device with a guide frame member and a drive motor; positioning the guide frame member in a desired location; and moving the hammer device and shaft downwardly along the guide frame member into the ground to make a hole in the ground. The positioning operation may also include positioning an alignment template about a marked location; positioning a centering plate within the alignment template, the centering plate being positioned about the marked location; securing the alignment template into the ground; removing the centering plate from the alignment template; and positioning the shaft at a desired location within the alignment template. In this manner, a hole can be created in a precise location.

The features, utilities and advantages of the various embodiments of the invention will be apparent from the following more particular description of embodiments of the invention as illustrated in the accompanying drawings.

DETAILED DESCRIPTION

Figure 1:
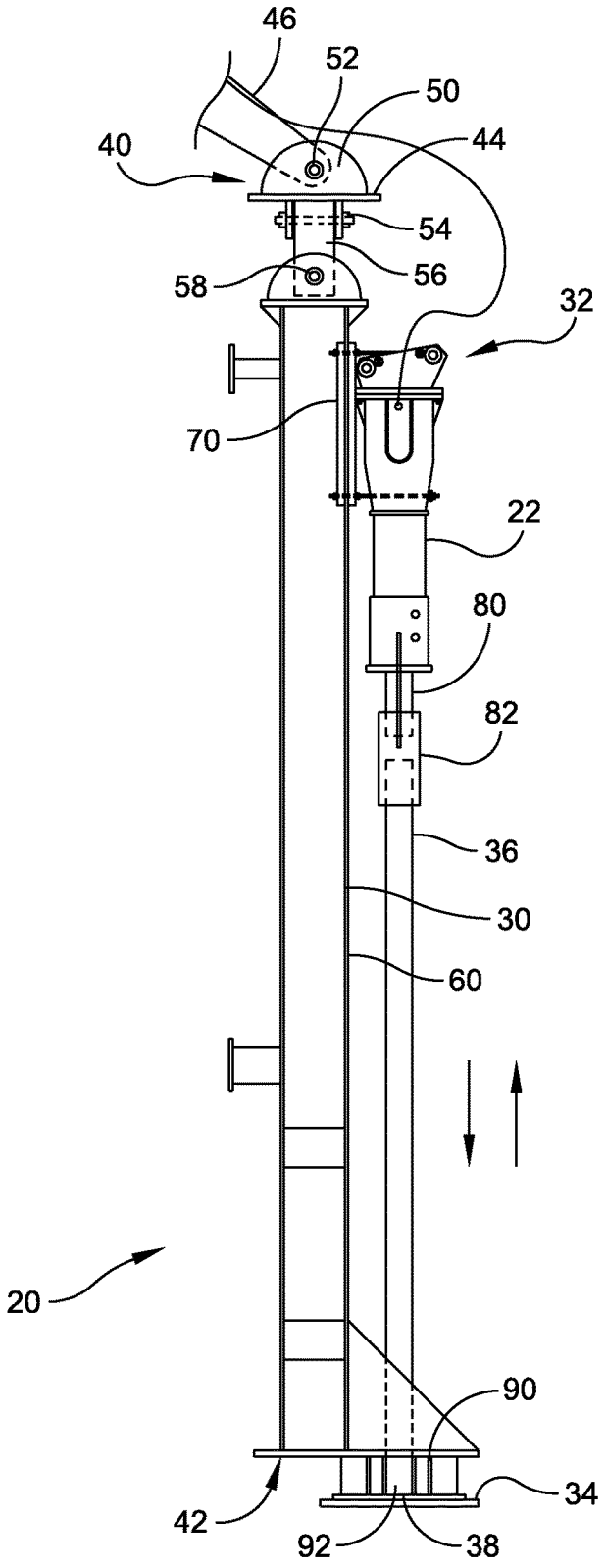
FIG. 1 illustrates an example of guide device for creating a hole in the ground, in accordance with one embodiment of the present invention.

Disclosed herein are various embodiments of a guide device 20, which can be used to create holes in the ground or other surfaces. Embodiments of the guide device 20 enable different types of boring, drilling, or driving equipment 22 (such as hammering devices, auguring tools, boring tools, displacement tools, drills, or rotary drive devices; and for simplicity of this description, these devices are referred to as a hammer 22, but could be replaced with a power drill or other power device as desired) to be mounted to the guide device 20 and controllably moved into the ground to produce precision holes and bores 24 (see FIG. 15).

Various embodiments of the invention are disclosed herein, and various uses of embodiments of the invention are possible. In one example, the guide device 20 can be use to create a pilot hole 24 for later insertion of a pile member or other structural support member or material into the pilot hole 24, which can then be used to support a foundation or other structure. Other examples of possible uses of a guide device 20 include creating holes 24 in the ground that can be used to receive pier members, anchor members or other structural members; or to create annular spaces 24 for such things as concrete or pressure grouted piles; or used to mount rock drilling equipments to create precision placed holes 24 in hard foundations.

One significant advantage of the use of a guide device 20 in accordance with embodiments of the present invention is that the holes 24 created in the ground may be made by compressing soil materials, which has the effect of increasing soil density around the hole 24, thereby creating a more rigid and accurate hole 24 (i.e., within higher dimensional tolerances) when compared with holes created by drilling/boring/excavation.

As described below, an alignment system 26 and method (FIGS. 5-12) for providing precise alignment of the guide device 20 are also disclosed herein. The alignment system 26 can be used in conjunction with a guide device 20, for instance to create a precisely positioned hole 24 in the ground at a location previously marked by a survey pin. However, it is understood that embodiments of the guide device 20 can be used with or without the alignment system 26 disclosed herein, or with different alignment systems, depending upon the particular implementation.

Figure 2:
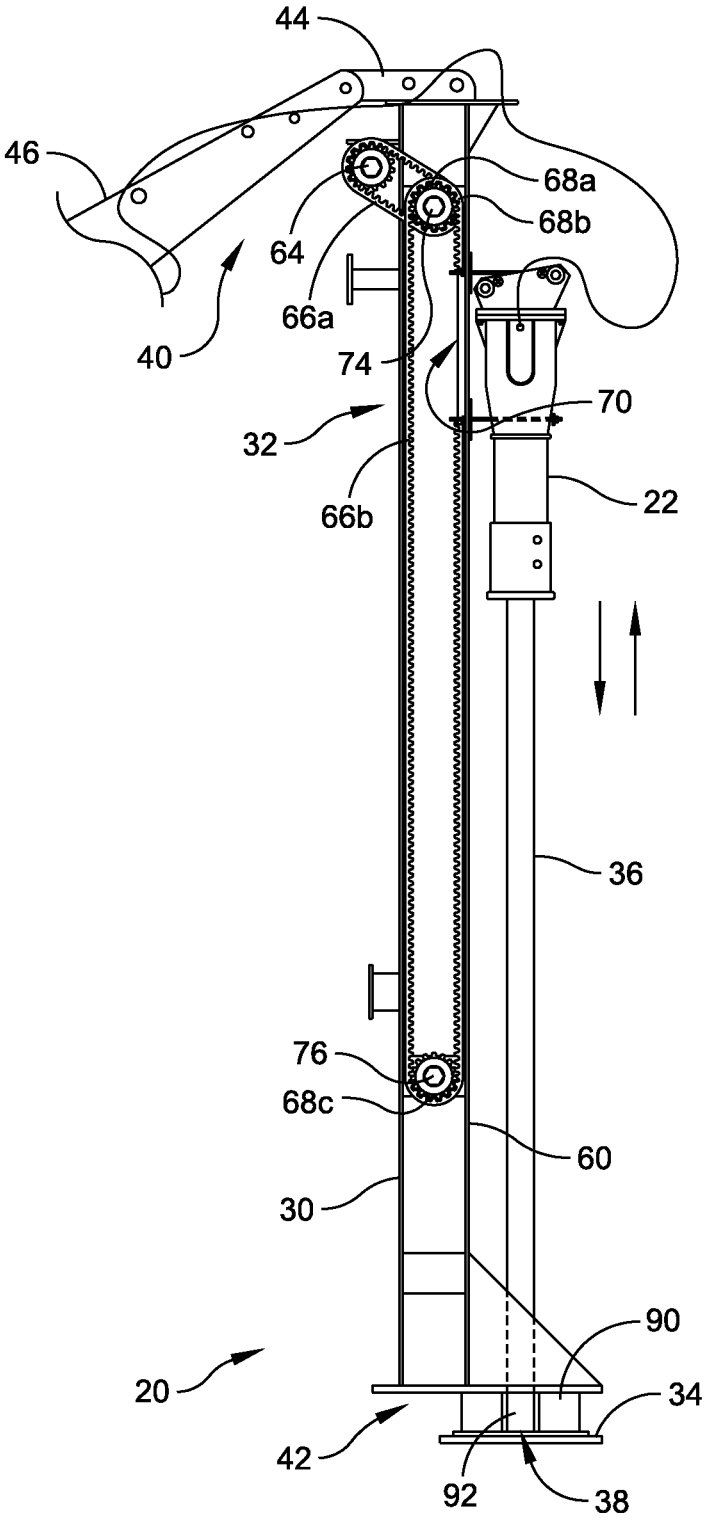
FIG. 2 illustrates another example of a device for creating a hole in the ground, in accordance with one embodiment of the present invention.
Figure 3:
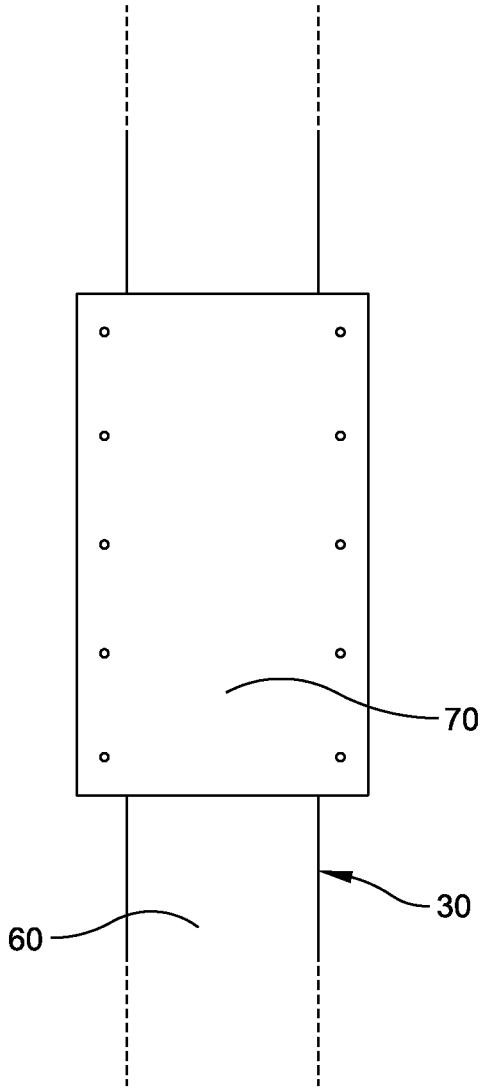
FIG. 3 illustrates a portion of a mounting plate of a guide frame member, in accordance with an embodiment of the present invention.
Figure 13:
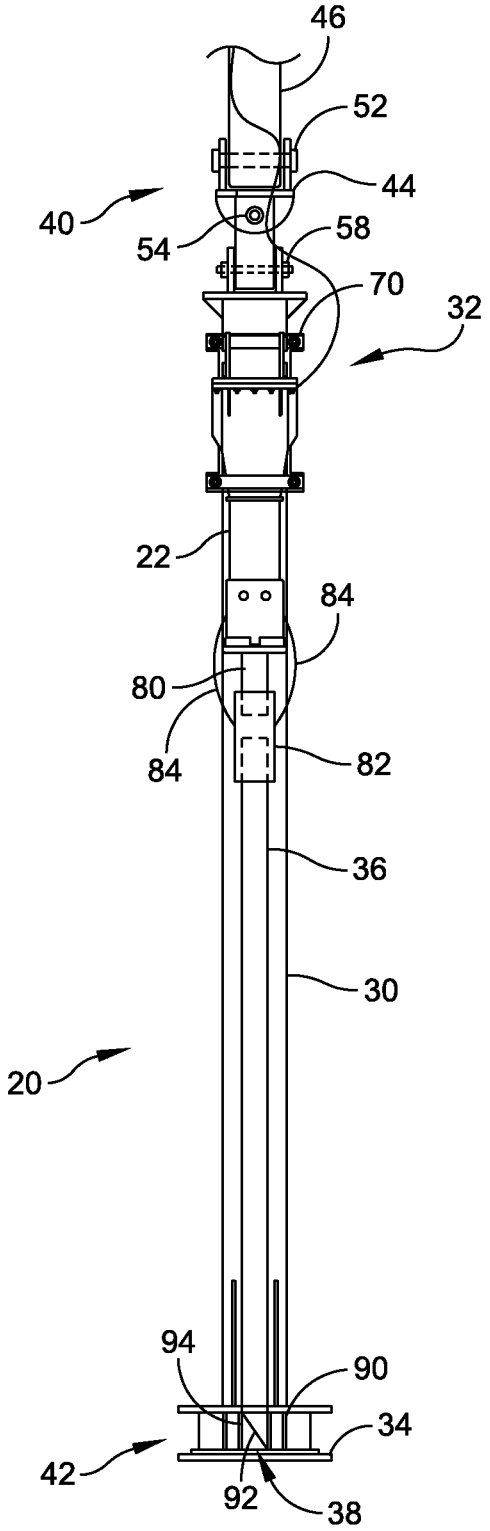
FIG. 13 illustrates a front view of the guide device of FIG. 1, in accordance with one embodiment of the present invention.

Referring to FIGS. 1-2 and 13, in one embodiment of the invention, a guide device 20 includes a power hammer 22 such as a percussion-type hammer (or if desired, a power drill could be used in place of power hammer); a guide frame member 30, which is elongated and rigid and may be made of steel or other rigid material; a movement control assembly 32 for controllably moving the hammer 22 along the guide frame member 30. If desired, the guide device 20 may also include a centering plate 34 to position a hammer shaft 36 and tip 38 relative to an alignment system 26, described below. The guide device 20 may be adapted to be attached to an excavator or other large machinery (not shown) which can lift, move and place the guide device 20 into a desired position or location.

The guide frame member 30 defines a proximate end 40 and a distal end 42, wherein the proximate end 40 may be attached through a swivel mount 44 (and other structures such as an arm or carrier boom 46) to the excavator or heavy machinery. An example of a swivel mount 44 is shown in FIGS. 1 and 13, and permits the guide frame member 30 (and hammer 22) to be moved along multiple independent axis as the guide frame member 30/hammer 22 hang from the excavator arm 46 in a vertical position, so that the hammer 22 can be positioned as desired by a user.

In one example in FIGS. 1 and 13, the swivel mount 44 includes a first member 50 that connects with a machine boom 46 (i.e., of the excavator or other machine) at a first swivel axis 52. The first member 50 also has a second swivel axis 54, wherein the second swivel axis 54 is 90 degrees relative to the first swivel axis 52. A second member 56 is coupled on one end to the second swivel axis 54, and the second member 56 has on its opposing end a third swivel axis 58 which is at 90 degrees to the second swivel axis 54. The top of the guide frame member 30 is connected to the second member 56 about the third swivel axis 58.

The distal end 42 of the guide frame member 30 is adapted, when in use, to position the hammer tip 38 at the precise location where the hole 24 is to be created on the ground or other surface.

As shown in FIGS. 1-2 and 4, the guide frame member 30 defines a straight plane or bearing surface 60 upon which a hammer 22, such as a hydraulic hammer or other percussion-type hammer, rides upon. In one embodiment, the guide frame member may be formed using an I-beam or structure that defines at least one substantially flat/straight bearing surface 60.

Various different types of hammers 22 can be used in different embodiments of the present invention. In one example, the hammer 22 is a breaker device, such as Model H120 or Models H120-H160 hydraulic breakers/hammer made by Caterpillar company of Illinois; having specifications of 5000 ft-lb of impact energy in one example. It is understood that this is provided by way of example only, and that the specific model and performance characteristics of the hammer 22 or other type of device used will depend upon the particular implementation.

A movement control assembly 32 is provided that controllably raises and lowers the hammer 22 along the guide frame member 30. In one example and as shown in FIG. 2, the movement control assembly 32 may include a drive motor 64 (i.e., a hydraulic drive motor) connected through one or more chains/belts 66 and gears 68, to a mounting plate 70 (FIGS. 1-4) that supports and is secured to the hammer 22.

As shown in the sectional view of FIG. 4, the mounting plate 70 may include L-shaped or U-shaped support members 72 connected along the sides of the mounting plate 70 so that the mounting plate 70 moves linearly only along the length of the guide frame member 30, but does not rotate relative to the guide frame member 30.

Figure 4A:
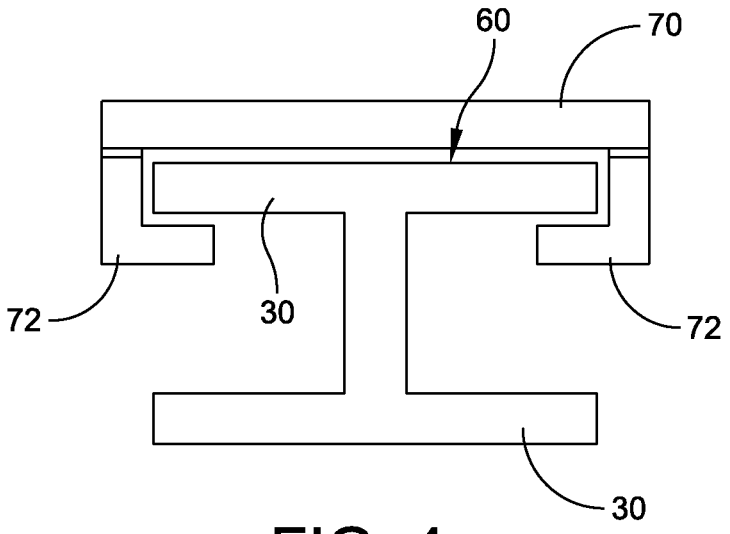
FIGS. 4*a-b* illustrate sectional views of a portion of embodiments of a mounting plate and a guide frame member, in accordance with embodiments of the present invention.
Figure 4B:
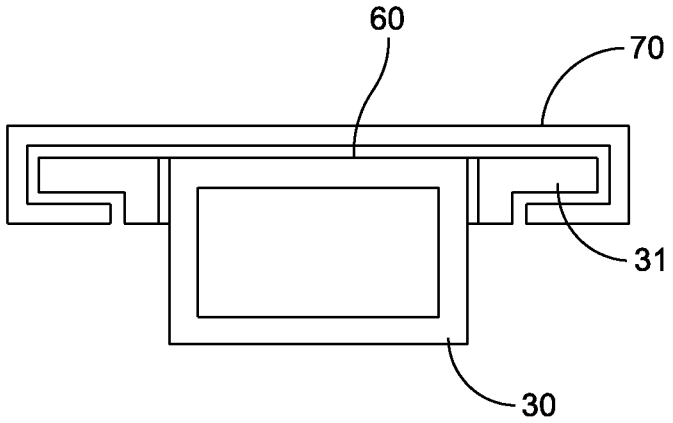

In another embodiment as shown in FIG. 4*b*, the guide frame member may be formed using a square or rectangular beam 30, in place of the I-beam shown in FIG. 4*a*. In FIG. 4*b*, the rectangular beam 30 may be provided with flanges 31 that can be formed from angled or L-shaped iron that is welded to the beam 30. The mounting plate 70 is positioned to slide along the surface 60 defined by a portion of the beam 60 and the flanges 31. By way of example only without limiting the scope of embodiments of the inventions described herein, the 60 beam may be approximately 24 feet long, 10 inches wide, 6 inches high, with a wall thickness of 9/16 inches.

In one example, the drive motor 64 is affixed to the guide frame member 30 and drives a first chain/belt 66*a* that is connected to a first upper gear 68*a* about a first upper gear shaft 74, positioned towards the proximate end 40 of the guide frame member 30. The first upper gear shaft 74 also has a second upper gear 68*b* attached thereto which is connected through a chain/belt 66*b* to a first lower gear 68*c* rotating about a lower gear shaft 76 positioned towards the distal end 42 of the guide frame member 30; and this chain/belt 66*b* is connected to one side of the mounting plate 70. In one implementation, the first upper gear shaft 74 also has a second upper gear attached thereto which is connected through another chain/belt to a second lower gear rotating about the lower gear shaft 76 positioned towards the distal end of the guide frame member; and this chain/belt is connected to the other side of the mounting plate 70. In this configuration, the drive motor 64 is connected with both sides of the mounting plate 70 to evenly move the mounting plate 70/hammer 22 along the guide frame member 30.

FIG. 1 shows one example of how the hammer 22 can be attached to the mounting plate 70, using spacer rails/shims and plates if needed. In one example, the hammer 22 has a bit 80 that is connected through a sleeve 82 to an elongated solid shaft 36, the sleeve 82 being integral with the elongated shaft 36 in one example. The elongated shaft 36 serves as a solid piloting tool, in one example, that is hammered into the ground to create the precision hole 24 during use.

In one example, the shaft 36 has a round, generally flat tip that defines the hammer tip 38, although other hammer tip shapes can be used depending upon the particular implementation. For instance, the shaft 36 can have a diameter of 4.5 inches and a length of 12 feet. It is understood that this is provided by way of example only, and that the specific dimensions of the hammer tip 38 will depend upon the particular implementation.

The shaft 36 may be removable from the hammer device 22 via the sleeve 82, so that various different shafts 36 can be attached to the hammer 22, or so that the shaft 36 can be replaced if it becomes damaged. The shaft 36 may be sized and shaped to create the desired dimensions (width, shape, and depth) of the hole 24. FIG. 1 shows an example of a sleeve 82 connecting a bit 80 of the hammer 22 to the shaft 36. One or more cables or chains 84 (FIG. 13) may be attached between the hammer 22 and the sleeve 82 and the shaft 36, so that when the hammer 22 is moved upwardly along the guide frame member 30 away from the ground (i.e., after the hole 24 has been made), the cables/chains 84 pull upwardly on the sleeve 82 and the shaft 36 so that the shaft 36 is removed from the hole 24.

The distal end 42 of the guide frame member 30 may include a centering sleeve 90 to help support, guide and maintain the shaft 36 of the hammer 22 in position. In one example, the centering sleeve 90 projects outwardly from the distal end 42 of the guide frame member 30 and defines an opening or hole 92 to receive the free end (i.e., the hammer tip 38) of the shaft 36.

The centering sleeve 90 maintains the shaft 36 of the hammer 22 in a substantially parallel position relative to the bearing surface 60 of the guide frame member 30.

In one example of an embodiment of the invention, the bottom of the centering sleeve 90 may be provided with a centering plate 34 that is shaped to fit into an alignment system 26, as will be discussed below with respect to FIGS. 5-12. In the examples shown herein, the centering plate 34 is shown as circular/round and substantially flat, but it is understood that other shapes can be used so long as the centering plate 34 is adapted to fit within the alignment system 26.

Figure 14:
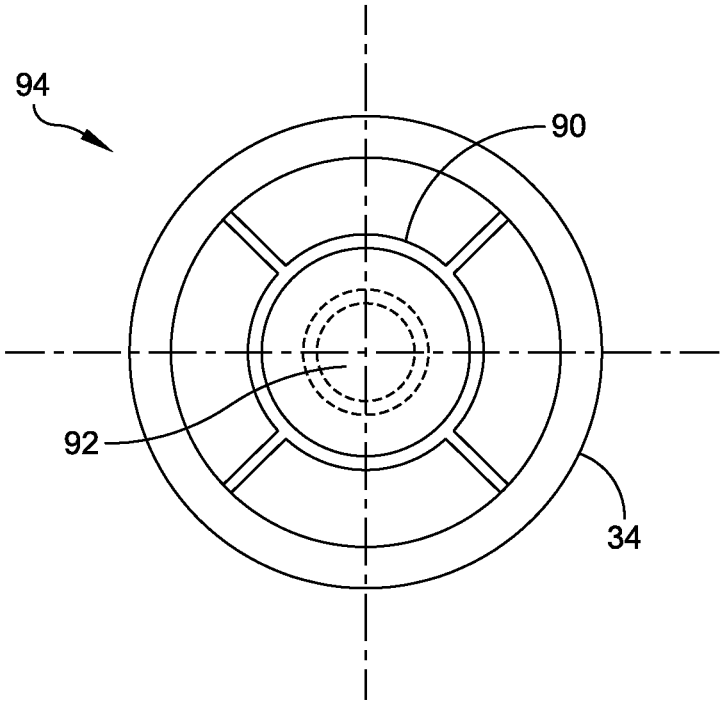
FIG. 14 illustrates a sectional view taken along the A-section line of FIG. 1 and FIG. 13, showing the reducing sleeve that may be used, in accordance with one embodiment of the present invention.

As shown in FIG. 13-14, interchangeable reducing sleeves 94 may be provided for placement inside of the hole 92 of the centering sleeve 90—in this way, a reducing sleeve 94 can reduce the size of the opening 92 to receive a shaft 36 of different diameter. Through the use of different reducing sleeves 94, the guide device 20 can be adapted to be used with shafts 36 of different diameters, which makes the guide device 20 versatile when used in different applications or job sites to create holes 24 of different diameters.

Controls may be provided for controlling the operation and direction of the drive motor 64, such controls being accessible by an operator. In one example of an embodiment of the invention, when the drive motor 64 is activated in a first direction (i.e., clockwise), it causes rotation of a gear connected to a chain that is connected with the mounting plate 70 so that the hammer 22 is moved downwardly into the ground. When the drive motor 64 is activated in an opposition second direction (i.e., counter-clockwise), it causes rotation of a gear connected to a chain that is connected with the mounting plate 70 so that the hammer 22 is moved upwardly away from the ground.

In another example, the upward or downward movement of the hammer 22 along the guide frame member 30 is controlled by an operator who controls the drive motor 64. Depending upon the implementation, stops or limits (i.e., limit switches) can be used to control the extent of upward or downward movement of the hammer 22 along the guide frame member 30. The amount of downward movement will be dependant upon the desired depth of the hole 24 being created, in one example.

Figure 15:
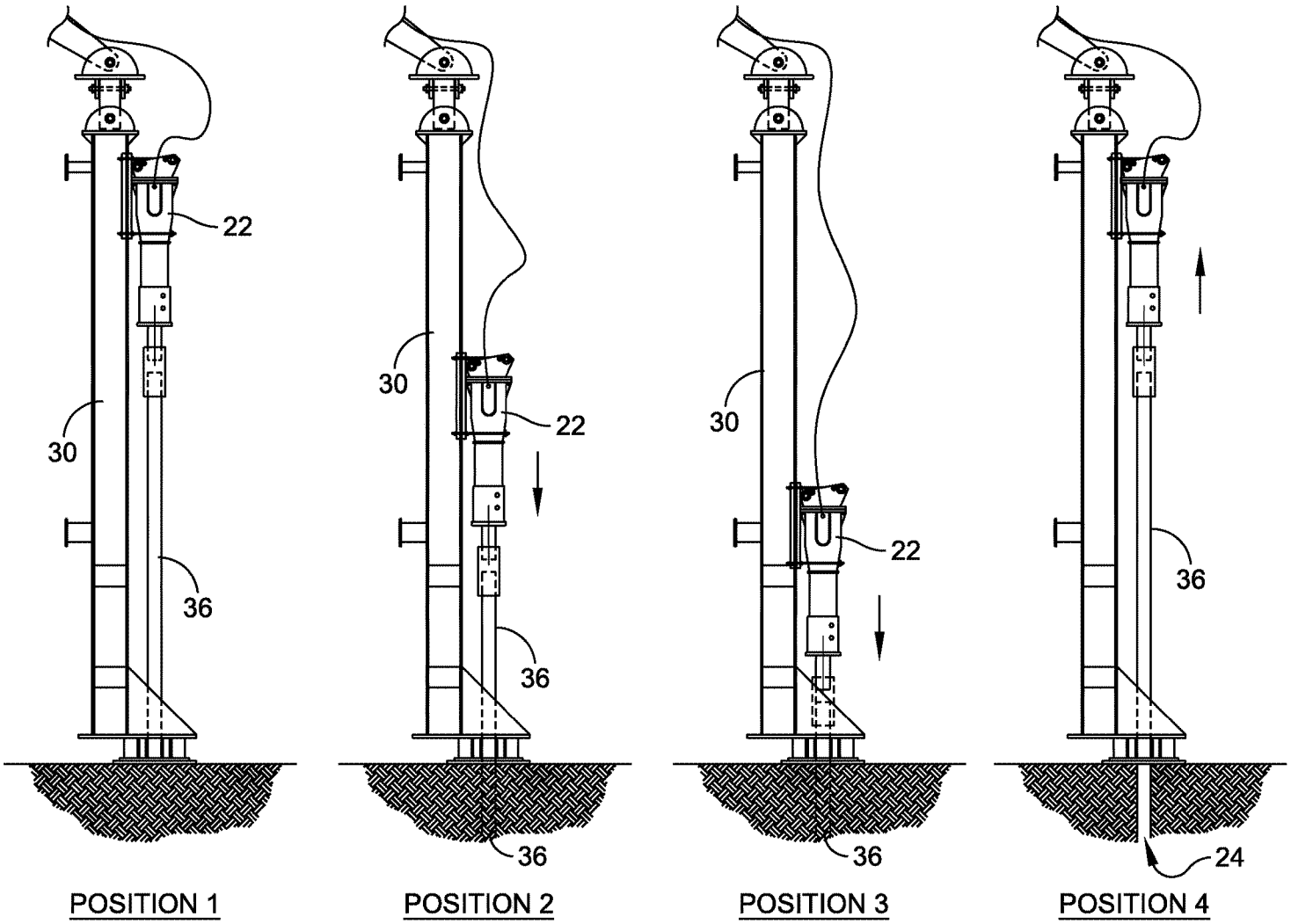
FIG. 15 illustrates an example of a sequence of positions for the guide device in use to create a precise hole in the ground, in accordance with an embodiment of the present invention.

In operation and as shown in FIG. 15, when the guide device 20 is placed into its working position to create a hole 24 in the ground, the guide frame member 30 and hammer 22 are vertically aligned and positioned, with the hammer 22 in an initial upward/top vertical position (position 1). As the hammer 22 contacts the ground and begins to compress the ground materials, the hammer 22 is slowly and controllably moved downwardly along the guide frame member 30 (position 2). The drive motor 64 continues to drive the hammer 22 downwardly along the guide frame member 30, and therefore the hammer tip 38 further penetrates, hammers and compacts into the ground as the hole 24 is being created, until the point at which the full depth of the hole 24 has been created (position 3). When the full depth of the hole 24 has been created, the drive motor 64 is stopped and reversed so that the hammer 22 and shaft 36 begins to move in an opposite upward direction out of the hole 24. Once the hammer shaft 36 and tip 38 have been removed from the hole 24 (position 4), the drive motor 64 can again be stopped, and the guide device 20 can be repositioned to another location along the ground to begin the process to create another hole.

FIGS. 5-11 illustrate examples of an alignment system 26 that can be used to precisely align a guide device 20. In one example, an alignment system 26 includes an alignment template 100 (FIGS. 5-6) and a centering plate 102 (FIGS. 6-8), wherein the alignment template 100 is adapted to be placed along the ground, and the centering plate 102 is adapted to be placed within the alignment template 100 to align the alignment system 26 relative to a survey pin, mark, hub, nail or other indicator. Once the desired alignment is achieved of the centering plate 102 within the alignment template 100, the alignment template 100 is secured into the ground and the centering plate 102 removed from within the alignment template 100. The alignment template 100 is now ready to receive therein the centering plate 34 on the distal end 42 of the guide device 20 (FIGS. 1-2) in order to precisely align the hammer tip 38/hammer shaft 36 of the guide device 20.

Figure 5:
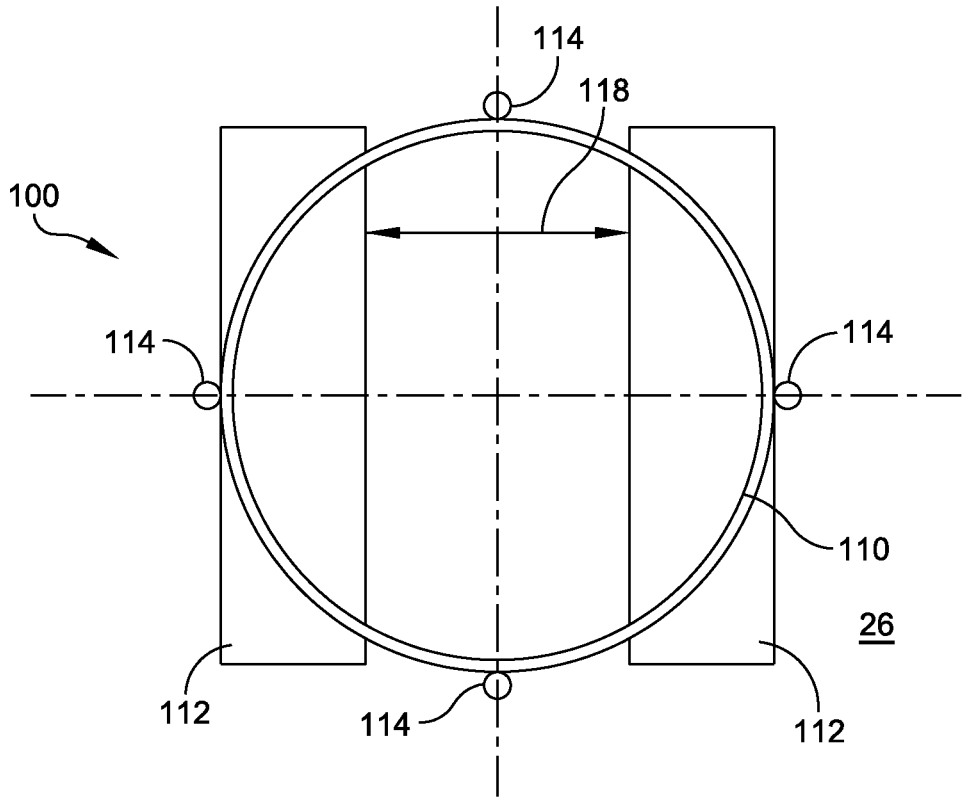
FIG. 5 illustrates an example an alignment template for receiving and aligning the distal end of the guide device of FIG. 1, in accordance with an embodiment of the present invention.
Figure 6:
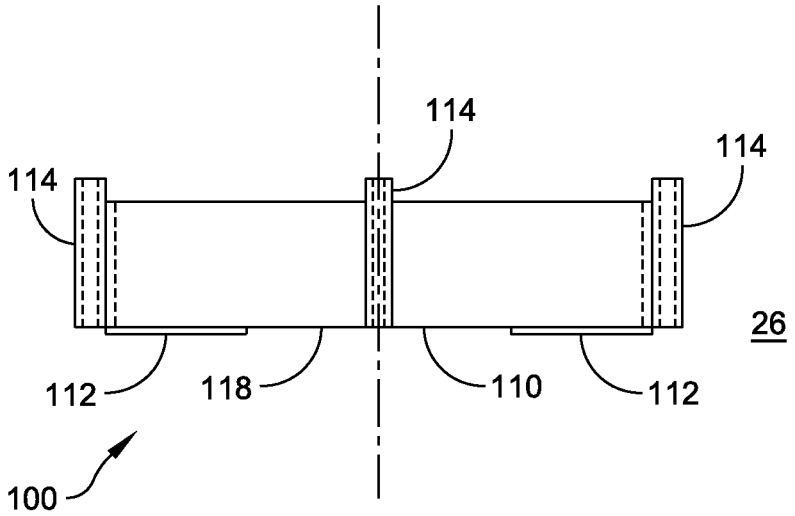
FIG. 6 illustrates a front view of the alignment template of FIG. 5, in accordance with an embodiment of the present invention.

As shown in FIGS. 5-6, an alignment template 100 may include a retaining ring 110 having one or more support plates 112 connected thereto along a lower edge. One or more pins sleeves 114 can be provided about the perimeter of the retaining ring 110, wherein each pin sleeve 114 is adapted to receive securing pin 116 penetrating the ground, thereby securing the alignment template 100 in place. As shown in FIG. 6, the pin sleeves 114 are positioned with the bottom ends substantially flush with the lower edge of the retaining ring 110, and the upper ends of the pin sleeves 114 extend above the upper edge of the retaining ring 110 to so pins 116 can be hammered by a user into the ground through the pin sleeves 114 without significantly moving the alignment template 100.

In one example, the one or more support plates 112 are substantially flat and rectangular, and are positioned about opposing ends of the lower edge of the retaining ring 110. A gap or space 118 is defined between the interior edges of the support plates 112 within the interior of the area defined by the retaining ring 110.

The retaining ring 110, support plates 112, and pin sleeves 114 may be made of metal such as steel or other rigid material. In one example, a heavy material such as steel helps to keep the alignment template 100 in place despite winds, rains, or other environmental conditions. Of course, once at least two pins are hammered into the ground through at least two pin sleeves 114, the alignment template 100 will not typically move due to winds, rains or other conditions.

Figure 7:
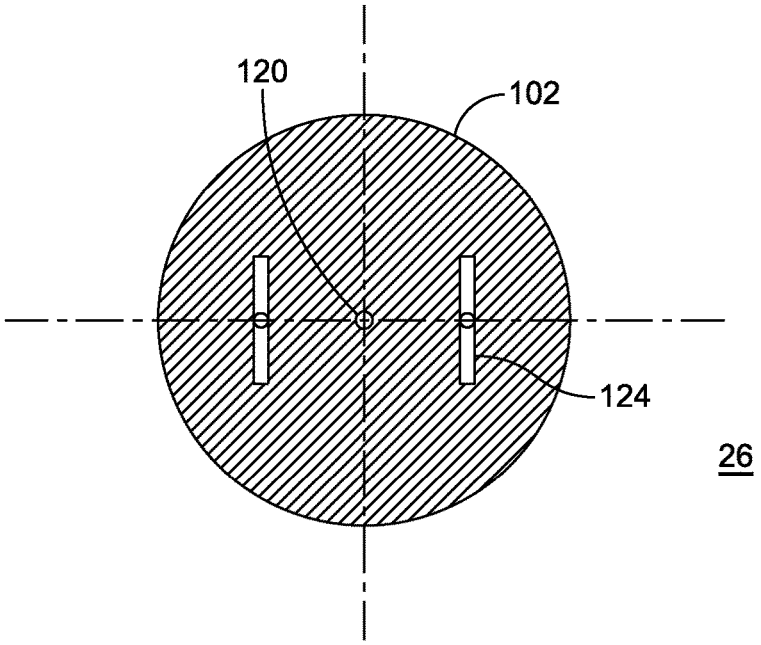
FIG. 7 illustrates an example a centering plate that is adapted to be inserted into the alignment template of FIG. 6, in accordance with an embodiment of the present invention.
Figure 8:
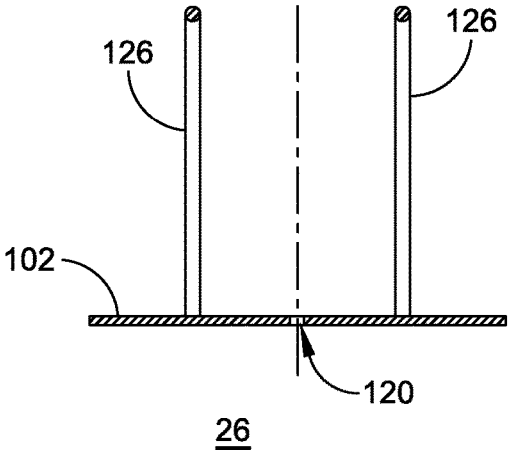
FIG. 8 illustrates a front view of the centering plate of FIG. 7, in accordance with an embodiment of the present invention.
Figure 9:
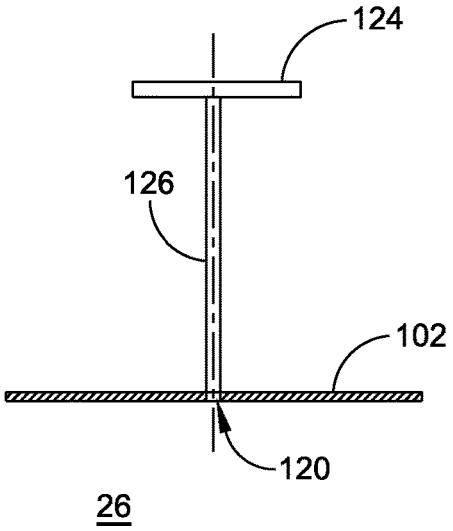
FIG. 9 illustrates a side view of the centering plate of FIG. 7, in accordance with an embodiment of the present invention.

Referring to FIGS. 7-9, one example of a centering plate 102 is illustrated. The centering plate 102 is generally circular and flat. At the center of the centering plate 102, a centering hole 120 is provided so that the centering plate 102 can be positioned atop a surveying pin/stake or other marker 122 while the centering plate 102 is substantially flush to the ground. The centering plate 102 may be provided with one or more lifting handles 124 connected to the centering plate 102 via handle shafts 126. The centering plate 102 is sized so that it fits within the retaining ring 110 of the alignment template 100.

Figure 10A:
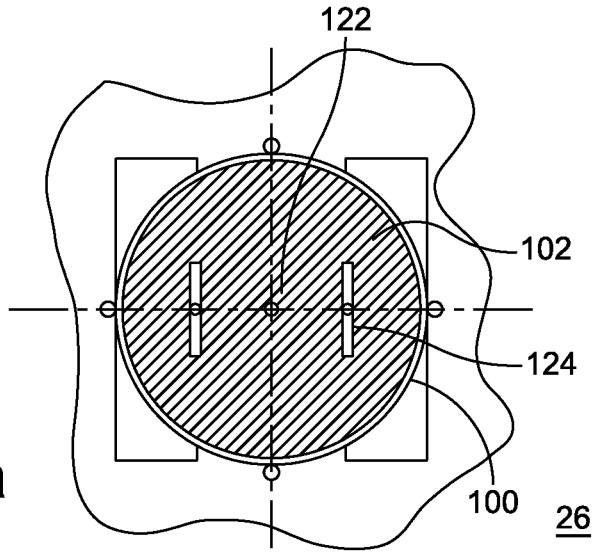
FIGS. 10*a-b* illustrate an example of an alignment template, with a centering plate positioned therein, the centering plate being centered about a survey nail, in accordance with an embodiment of the present invention.
Figure 10B:
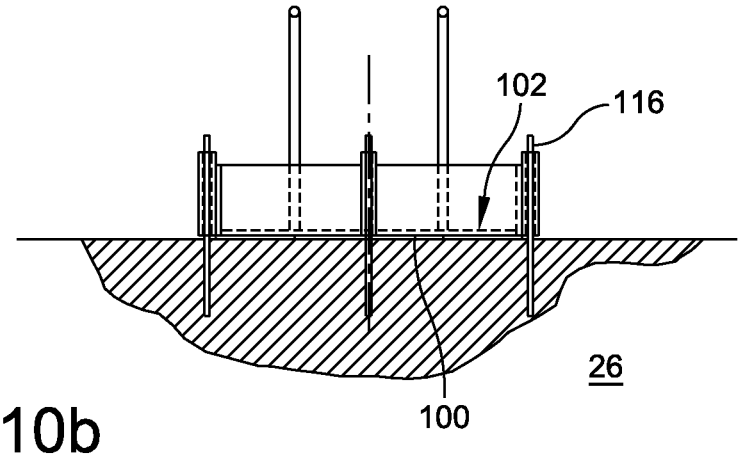
Figure 11:
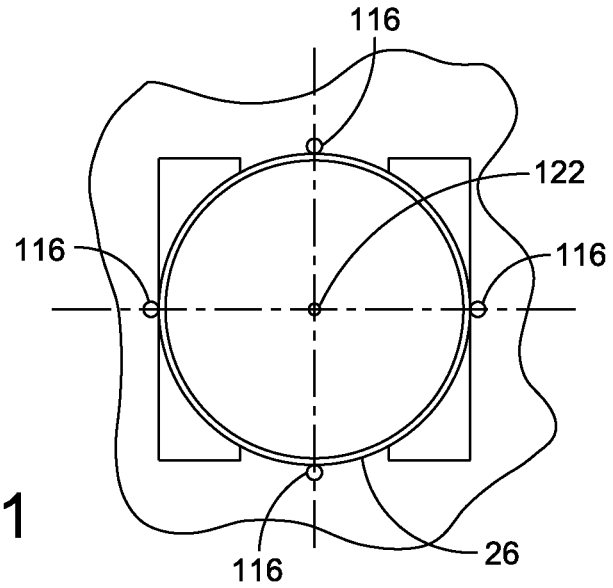
FIG. 11 illustrates an example of an alignment template removably secured into the ground, without the centering plate of FIG. 10, alignment template being centered about a survey hub, in accordance with an embodiment of the present invention.

FIGS. 10*a-b* illustrate an example of a centering plate 102 positioned within an alignment template 100, wherein the centering plate 102 is centered on a survey pin 122. The securing pins 116 are positioned within the pin sleeves 114 so that the securing pins 116 can be hammered into the ground to secure the alignment template 100 in place. Then the centering plate 102 can be removed using its handles 124 by a user from the alignment template 100, as shown in FIG. 11, which leaves the alignment template 100 ready to receive and guide the guide device 22 into place, to hammer a hole 24 precisely on the survey pin 122.

Figure 12:
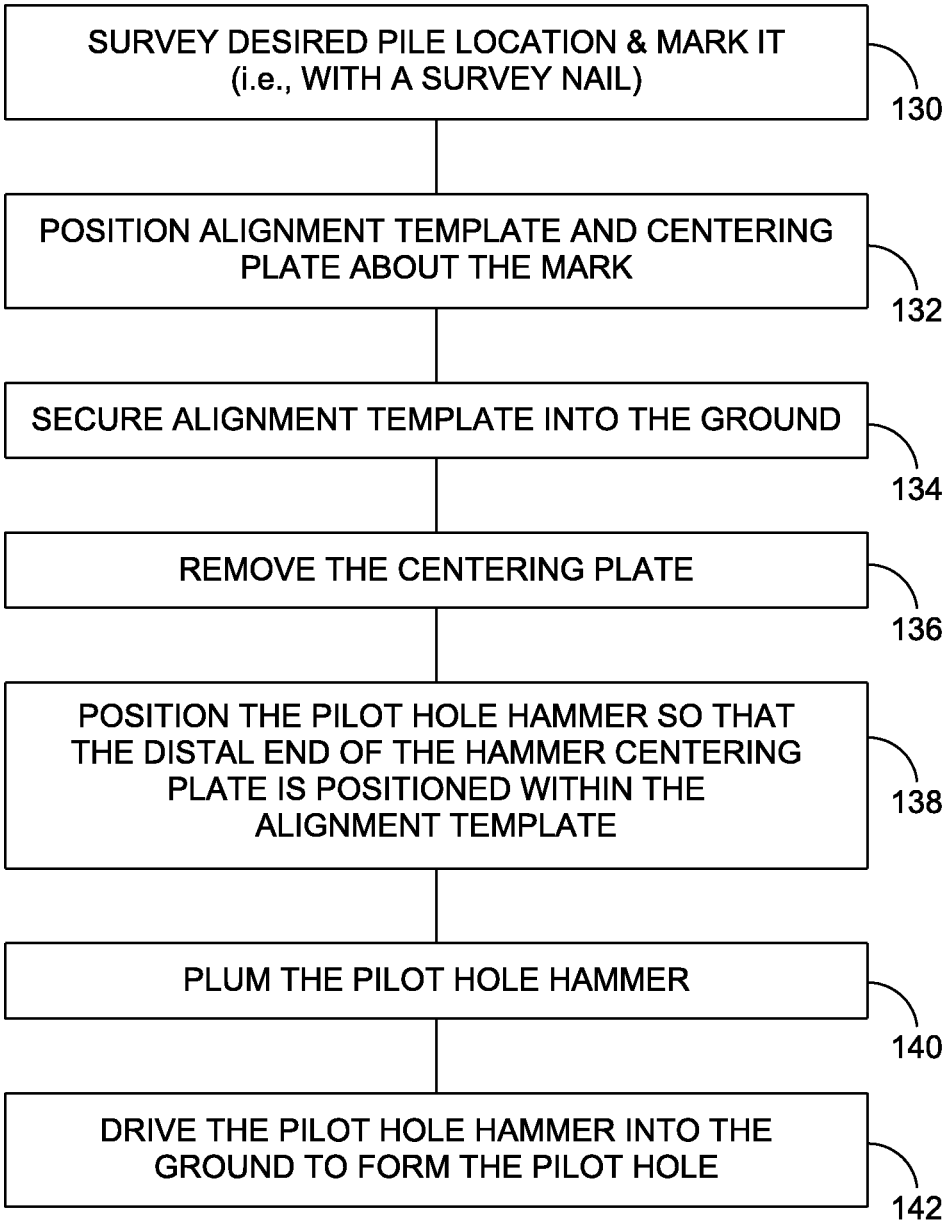
FIG. 12 illustrates an example of operations for forming a hole, such as a pilot hole, in accordance with an embodiment of the present invention.

FIG. 12 illustrates an example of a method for forming a hole 24, such as to receive a pile member or other foundation support member or structural member, in accordance with an embodiment of the present invention. At operation 130, a location is surveyed and marked with one or more locations where holes will be made in the ground. The survey marks may be made, for instance, with survey hubs (i.e., nails, survey stakes, or other conventional survey markers (these terms are used interchangably)). At operation 132, an alignment template is positioned about/around the survey nail, and a centering plate is positioned within the alignment template so that the centering plate is centered on the survey nail.

At operation 134, the alignment template is secured into the ground, for instance by one or more securing pins being hammered into the ground through pin sleeves of the alignment template. At operation 136, the centering plate is removed from the alignment template, the alignment template having been aligned and secured to the ground.

At operation 138, a guide device having a power tool (such as a percussion-type hammer or power drill) is provided with one or more structures about its distal end that are adapted to mate with, key into, or fit within the alignment template. The guide device is positioned so that the distal end of the guide device is positioned within the alignment template. In this way and because the alignment template was aligned to the survey hub, and the guide device is aligned with respect to the alignment template, the guide device is now aligned with respect to the survey nail.

At operation 140, the guide device is plumbed, for instance by a user, so that the hammer shaft is on a true vertical line relative to the ground.

At operation 142, the guide device is activated, so that the hammer tip and shaft are driven into the ground while being held in precise alignment by the alignment template, to form the desired hole at the position indicated by the survey hub. After the hole is formed, the guide device is removed from the hole thereby exposing the hole for use. As mentioned above, due to the percussive nature of the guide device, the hole is formed without materials such as spoils being brought to the surface, the hole having sidewalls with increased soil density, which tends to make the hole more rigid and improves its load bearing capacity when compared with holes formed by drilling. The hole is also plumb and straight. Alternatively, if desired, the hole may be created at an precise angle, as disclosed in the co-pending U.S. patent application entitled "Alignment System and Method for Creating Holes for Piles or Other Support Members" filed Jun. 25, 2012 as U.S. application Ser. No. 13/532,611, now issued as U.S. Pat. No. 8,925,214, the disclosure of which is hereby incorporated by reference its entirety.

A particular implementation of an embodiment of the invention is now described by way of example only and without limiting the scope of the various embodiments of the inventions disclosed herein. In one example, where a precise and plumb hole was to be created in the ground, a 20 foot I-Beam, 10 inches wide and 10 inches tall was used as the guide frame member 30. A hydraulic hammer was attached to a slide plate 70 that traveled along the flanges of the I-Beam. The slide plate 70 was approximately 18 inches wide, 40 inches tall and 1 inch thick. The slide plate 70 was made from a rectangular steel plate with holes drilled to the outside of the guide frame 30. A spacer and slide retainer were created to give a "sandwich" effect to attach the slide plate 70 to the guide frame 30, bolted together through drilled holes to fit around the flange of the guide frame 30. A cradle was fabricated off of the slide plate 70 to enable attachment of the commercial hammer 22 to the slide plate 70. A roller chain was attached to each end of the slide plate 70, to sprockets 68. The sprockets 68 were attached to fabricated shaft assemblies 74, 76 driven by a gear reducing hydraulic drive motor 64. A 30 inch outside diameter circular plate 34 was attached to the base of the guide frame 30. Within the circular plate 34, a 4½ inch diameter circular hole 92 was cut. A 4½ solid bar shaft 36 with a sleeve 82 attached to the top end allowed it to slide over the hammer bit 80. This enabled the hammer 22 to directly hit the solid shaft 36 while the sleeve 82 maintained alignment of the shaft and hammer. Chains and cables 84 were attached to the drive sleeve 82 and the hammer 22 to enable retraction of the solid shaft 36 with the hammer 22. The guide frame 30 was attached to an excavator with a dual access swivel apparatus including a large square solid bar with holes drilled at both ends 90 degrees to each other enabling pivot points for at least 2 directions, side/side and fore/aft. Vertical adjustability was through the excavator. The bottom circular plate 34 fit inside the template alignment system 26 to create a precise hole 24 on location and plumb.

While embodiments of the present invention have been described in terms of creating holes such as pilot holes for receiving pile members, embodiments of the present invention can be used for forming various types of holes in the ground, such as for drilled piers, for micros piles, for grouted piles, and for anchors of various types, for instance for various foundations, or for creating a hole for any other purpose. Co-pending U.S. patent application entitled "Rotary Drive Tip System for Installation of Piles or Other Foundation Members into the Ground" filed Jun. 25, 2012 as U.S. application Ser. No. 12/532,623, Now issued as U.S. Pat. No. 9,068,318, the disclosure of which is hereby incorporated by reference its entirety, discloses the use of rotary drive tip system, which could be used with embodiments of the present invention. In embodiments of the invention where a rotary drive device (i.e., drill device) is used place of hammer 22, the rotary drive device 22 may drive a conventional drill bit or conventional claw bit, or may drive a rotary drive tip as described in the above-referenced co-pending application.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

It should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, as the following claims reflect, inventive aspects lie in less than all features of a single foregoing disclosed embodiment, and each embodiment described herein may contain more than one inventive feature.

While the invention has been particularly shown and described with reference to embodiments thereof, it will be understood by those skilled in the art that various other changes in the form and details may be made without departing from the spirit and scope of the invention.

The invention claimed is:

1. A guide device for forming a hole in the ground, comprising:

a rotary drive device having a drill bit;

a guide frame member for guiding the rotary drive device into one or more vertical positions along the guide frame member; and a movement control assembly between the rotary drive device and the guide frame, the movement control assembly selectively moving said rotary drive device downwardly and upwardly along said guide frame so that said drill bit penetrates the ground to form the hole; and an alignment device configured to be secured to the ground as a separate component from the guide frame member;

wherein the guide frame member further includes on one end a centering plate configured to mate with the alignment device configured to be secured to the ground as a separate component from the guide frame member; and wherein the centering plate is configured to be removed from the alignment device and wherein the rotary drive device is used to form the hole while the centering plate is removed from the alignment device.

2. The guide device of claim 1, wherein the drill bit has a circular cross-section.

3. The guide device of claim 1, wherein the rotary drive device has an elongated solid cylindrical shaft.

4. The guide device of claim 1, wherein the rotary drive device has a removable shaft portion.

5. The guide device of claim 1, wherein the guide frame member is adapted to be connected to an excavator.

6. The guide device of claim 1, wherein the guide frame member includes an I-beam portion.

7. The guide device of claim 1, wherein the guide frame member has on one end a centering sleeve for receiving a portion of a shaft of the rotary drive device.

8. The guide device of claim 1, wherein the movement control assembly includes a drive motor coupled with a mounting plate, the mounting plate secured to the rotary drive device.

9. The guide device of claim 1, wherein the movement control assembly controllably moves the mounting plate secured to the rotary drive device upwardly and downwardly along the guide frame member.

10. A guide device for forming a hole in the ground, comprising:

a rotary drive device having a drill bit;

a guide frame member for guiding the rotary drive device into one or more vertical positions along the guide frame member; and a movement control assembly between the rotary drive device and the guide frame, the movement control assembly selectively moving said rotary drive device downwardly and upwardly along said guide frame so that said drill bit penetrates the ground to form the hole; and an alignment device configured to be secured to the ground as a separate component from the guide frame member;

wherein the guide frame member further includes on one end a centering plate configured to mate within the alignment device configured to be secured to the ground as a separate component from the guide frame member; and wherein the centering plate is configured to be removed from the alignment device and wherein the rotary drive device is used to form the hole while the centering plate is removed from the alignment device.

11. The guide device of claim 10, wherein the hammer has an elongated solid cylindrical shaft terminating at the drill bit.

12. The guide device of claim 10, wherein the rotary drive device has a removable shaft portion.

13. The guide device of claim 10, wherein the guide frame member is adapted to be connected to an excavator for positioning the guide device in different locations to form multiple holes.

14. The guide device of claim 10, wherein the guide frame member includes an I-beam portion.

15. A method for guiding a rotary drive device with a shaft to create a hole in the ground, comprising:

connecting the rotary drive device with a guide frame member and a drive motor;

positioning an alignment template about a marked location, the alignment template configured to be secured to the ground as a separate component from the guide frame member;

positioning a centering plate within the alignment template; the centering plate being positioned about the marked location, wherein the guide frame member further includes on one end the centering plate configured to mate with the alignment template configured to be secured to the ground as a separate component from the guide frame member;

securing the alignment template into the ground;

removing the centering plate from the alignment template;

positioning the shaft at a desired location within the alignment template; and moving the rotary drive device and the shaft downwardly along the guide frame member into the ground to make a hole in the ground.

* * * * *